US005953697A

United States Patent [19]

Lin et al.

[11] Patent Number: 5,953,697

[45] Date of Patent: Sep. 14, 1999

[54] GAIN ESTIMATION SCHEME FOR LPC VOCODERS WITH A SHAPE INDEX BASED ON SIGNAL ENVELOPES

[75] Inventors: Chin-Teng Lin, Tainan; Hsin-An Lin, I-Lan, both of Taiwan

[73] Assignee: Holtek Semiconductor, Inc., Taiwan

[21] Appl. No.: 08/851,223

[22] Filed: May 5, 1997

[30] Foreign Application Priority Data

Dec. 19, 1996 [TW] Taiwan ..... 85115665

[51] Int. Cl.[6] ..... G10L 9/14

[52] U.S. Cl. ..... 704/225; 704/221; 704/223

[58] Field of Search ..... 704/221, 225, 704/223

[56] References Cited

U.S. PATENT DOCUMENTS 5,086,471 2/1992 Tanaka et al. ..... 704/222

5,664,055 9/1997 Kroon ..... 704/223

*Primary Examiner*—David D. Knepper

*Assistant Examiner*—Harold Zintel

[57] ABSTRACT

A gain estimation method for an LPC vocoder which utilizes shape indexes. The gain is estimated based on the envelope of the speech waveform. The gain is estimated such that the maximum amplitude of the synthetic speech just reaches the speech waveform envelope. The gain during voiced subframes is estimated as the minimum of the absolute value of ratio of the envelope and the impulse response of the LPC filter. The gain during unvoiced subframes is estimated as the minimum of the absolute value of the ratio of the envelope and the noise response of the LPC filter. The method results in a fast technique for estimating the gain.

6 Claims, 3 Drawing Sheets

| Index | Envelop Code | | | | | | | | Envelop Shape |
|---|---|---|---|---|---|---|---|---|---|
| 0 | 1.00 | 1.00 | 1.00 | 1.00 | 1.00 | 1.00 | 1.00 | 1.00 | |
| 1 | 0.60 | 0.66 | 0.73 | 0.79 | 0.86 | 0.93 | 1.00 | 1.00 | |
| 2 | 0.48 | 0.65 | 0.82 | 1.00 | 0.95 | 0.90 | 0.85 | 0.80 | |
| 3 | 0.81 | 0.84 | 0.87 | 0.91 | 0.94 | 0.96 | 0.98 | 1.00 | |
| 4 | 0.51 | 0.58 | 0.64 | 0.72 | 0.78 | 0.86 | 0.93 | 1.00 | |
| 5 | 1.00 | 0.98 | 0.82 | 0.71 | 0.69 | 0.84 | 0.96 | 0.99 | |
| 6 | 0.19 | 0.22 | 0.41 | 0.52 | 0.67 | 0.83 | 0.98 | 1.00 | |
| 7 | 0.40 | 0.52 | 0.64 | 0.76 | 0.88 | 1.00 | 1.00 | 1.00 | |
| 8 | 0.23 | 0.27 | 0.33 | 0.37 | 0.42 | 0.61 | 0.80 | 1.00 | |
| 9 | 0.88 | 0.91 | 0.94 | 1.00 | 0.99 | 0.95 | 0.91 | 0.87 | |
| 10 | 0.04 | 0.06 | 0.21 | 0.36 | 0.52 | 0.68 | 0.84 | 1.00 | |
| 11 | 1.00 | 0.76 | 0.54 | 0.39 | 0.31 | 0.27 | 0.23 | 0.21 | |
| 12 | 0.97 | 1.00 | 0.96 | 0.91 | 0.87 | 0.76 | 0.63 | 0.51 | |
| 13 | 1.00 | 0.95 | 0.91 | 0.87 | 0.83 | 0.79 | 0.75 | 0.75 | |
| 14 | 1.00 | 0.87 | 0.74 | 0.60 | 0.47 | 0.34 | 0.21 | 0.21 | |
| 15 | 1.00 | 0.99 | 0.96 | 0.94 | 0.91 | 0.90 | 0.89 | 0.89 | |

FIG. 3

GAIN ESTIMATION SCHEME FOR LPC VOCODERS WITH A SHAPE INDEX BASED ON SIGNAL ENVELOPES

BACKGROUND OF THE INVENTION (a) Field of the Invention

This invention relates to a method of speech vocoder decoding, and more particularly to a method of gain estimation scheme for the vocoder coding.

(b) Description of the Prior Art

The linear predictive coding (LPC) vocoder technique has been widely used for speech coding synthesizer applications (see for example, U.S. Pat. No. 4,910,781 to Ketchum et al. and U.S. Pat. No. 4,697,261 to Wang et al., the entire disclosures of which are herein incorporated by reference). Up to now, LPC-10 vocoders are widely employed for the low bit rate speech compression.

FIG. 1 shows a block diagram of the conventional LPC vocoder. The vocoder generally includes an impulse train generator 11, a random noise generator 12, a voiced/unvoiced switch 13, a gain unit 14, a LPC filter 15, and a LPC parameter setting unit 16.

The input signal of the vocoder is generated from either the impulse train generator 11 or the random noise generator 12. The impulse train generator 11 is capable of generating a periodic impulse train speech signal which is so-called voiced signal. On the other hand, the random noise generator 12 is capable of generating a white noise signal which is so-called unvoiced signal. Either the periodic impulse train signal generated by the impulse train generator 11 or the white noise signal generated by the random noise generator 12 is transmitted into the gain unit 14, according to the proper judgment of the voiced/unvoiced switch 13, and then excites a LPC all-pole filter 15 to produce an output S(n) which is scaled to match the level of the input speech.

The voicing decision, pitch period, filter coefficients, and gain are updated for every speech frame to track changes in the input speech. The overall gain of the synthetic speech needs to be set to match the level of the input speech in practical vocoder applications. Currently, there are two widely used methods of determining the gain. First, the gain can be determined by matching the energy in the speech signal with the energy of the linear predicted samples. This indeed is true when appropriate assumptions are made about the excitation signal to the LPC system. Some assumptions are that the predictive coefficients $a_k$ in the actual model is equal to the predictive coefficients $\alpha_k$ in the real model, the energy in the excitation signal Gu(n) for the actual model is equal to the energy in the error signal e(n) for the real model, u(n)=δ(n) for the voiced speech, and u(n) for the unvoiced speech is a zero mean, unity variance, white noise process. With these assumptions, the gain G, can be estimated by:

$$G = \sqrt{R(0) - \sum_{k=1}^{p} \alpha_k R(k)} \tag{1}$$

where R(.) is the auto-correlation of the speech signal, $\alpha_k$ is the LPC coefficients, and p is the predictor order.

Another method for gain computation is based on the root-mean-square (RMS) of samplings over the entire frame N of input speech which is defined as:

$$\mathrm{RMS} = \sqrt{\frac{\sum_{n=0}^{N-1} s(n)s(n)}{N}} \tag{2}$$

For unvoiced frames, the gain is simply estimated by the RMS. For voiced frames, the same RMS-based approach is used but the gain is more accurately estimated using a rectangular window which is a plural number of the current pitch period. The gain computed from either one of the above mentioned two methods is then uniformly quantized on a logarithmic scale using 7 bits.

Because the traditional LPC vocoder is an open loop system, a simple gain estimation scheme is not sufficient to accurately determine the amplitude of synthetic speech. Therefore, the present invention discloses a gain estimation scheme based on the outline of speech waveform, which is called the envelope shape, to eliminate the above described drawbacks.

SUMMARY OF THE INVENTION

Accordingly, it is a primary object of the present invention to provide a method of gain estimation scheme for the vocoder coding that can produce smoother and natural voice outputs for vocoder applications.

Another object of the present invention is to provide a method of gain estimation scheme based on the outline of speech waveform called envelope shape for the vocoder coding.

In accordance with these objects of the present invention, a novel gain estimation scheme for speech vocoder comprises the steps of: (a) obtaining a decoded envelope which includes shape index and quantized gain by matching an input speech from a predetermined codebook; (b) inputting either an aperiodic pulse or a white noise directly into a voiced/unvoiced decision unit; (c) dividing the input speech into a plurality of frames, and determining each frame of said input speech signal to be voiced or unvoiced by said voiced/unvoiced decision unit; (d) transmitting an interpolated linear predictive coding (LPC) coefficient into both the synthesis filter and a post filter; (e) transmitting the decoded envelope and synthesis speech signal into an amplitude calculation unit to generate a gain; (f) multiplying the gain and the synthetic speech signal to produce a synthesized speech output; and (g) transmitting the synthesized speech output and the interpolated LPC coefficient into the post filter to generate a smooth and natural enhanced synthetic speech output.

BRIEF DESCRIPTION OF THE DRAWINGS

For a full understanding of the invention, reference is provided to the following description taken in connection with the accompanying drawings, in which:

FIG. 3 illustrates the predetermined shape codewords of a 4-bit quantizer according to the present invention.

DETAILED DESCRIPTION OF THE PREFERRED EMBODIMENTS

The present invention discloses a gain estimation scheme based on the outline of speech waveform, which is called the envelope shape, to handle the above-mentioned problems.

Figure 1:
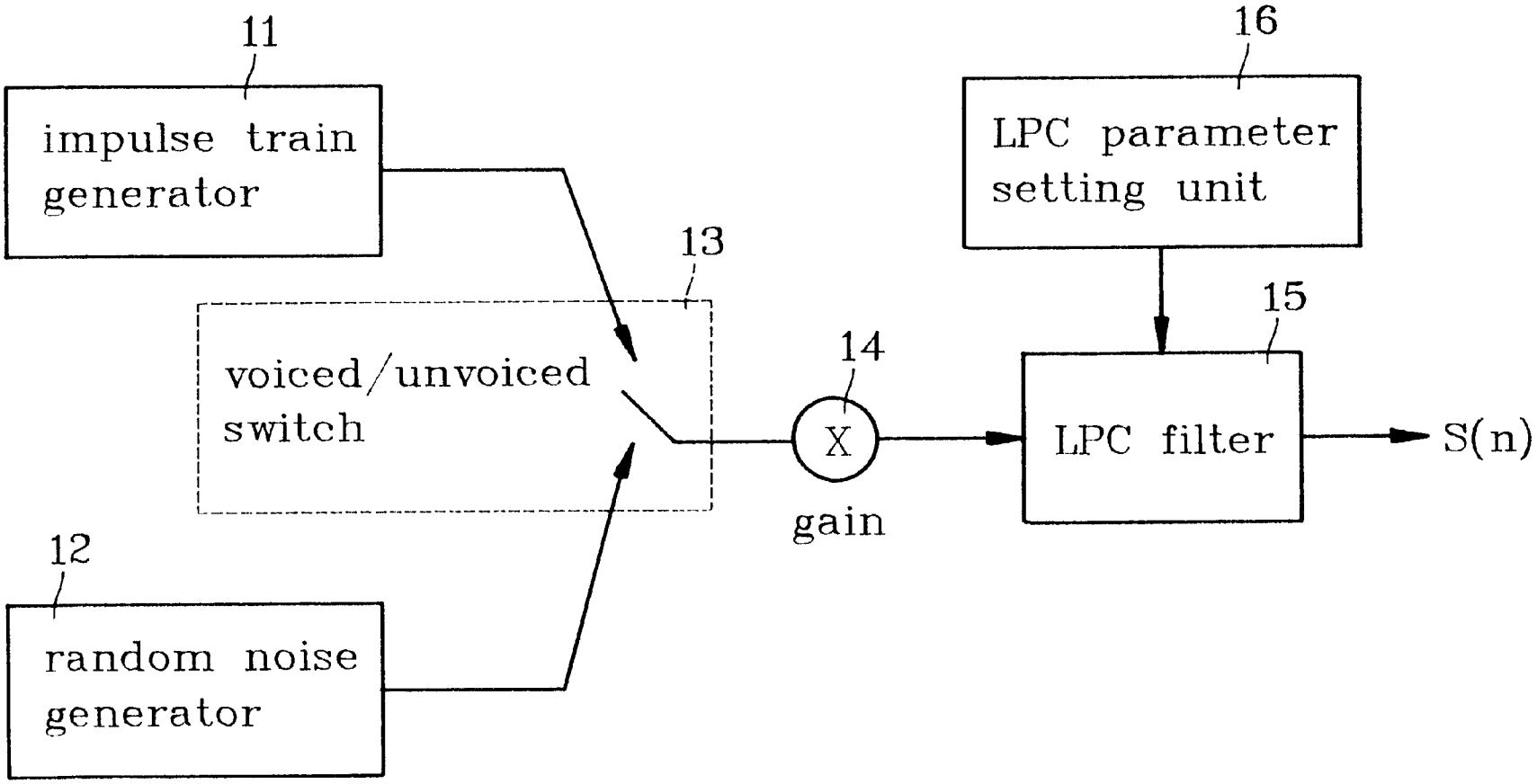
FIG. 1 (Prior Art)
FIG. 1 illustrates the block diagrams of the vocoder according to the prior art.
Figure 2:
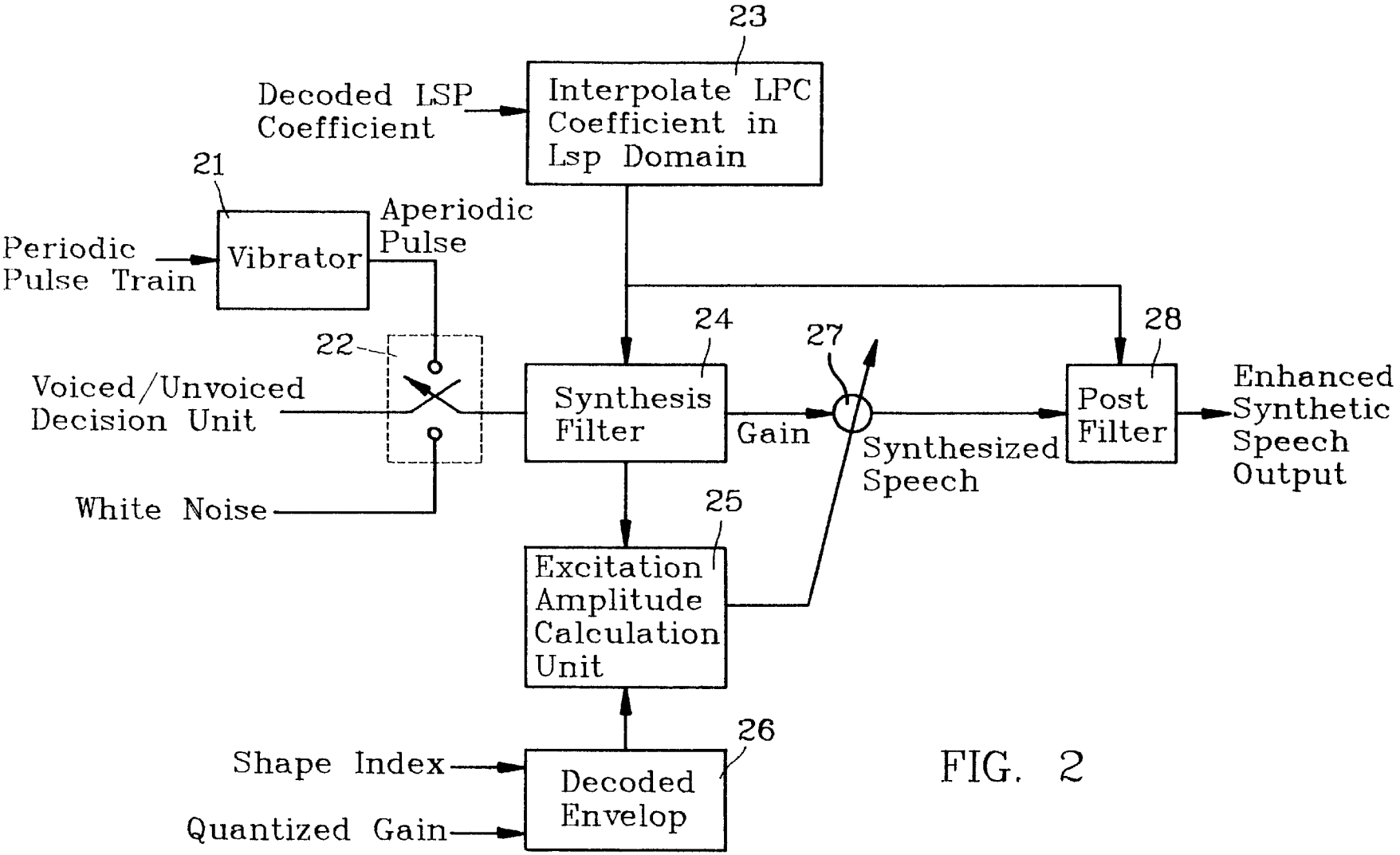
FIG. 2 illustrates the block diagram of the vocoder according to the present invention.

Referring now more particularly to FIG. 2, there is shown the block diagram of the vocoder according to the present invention. The vocoder generally comprises a vibrator 21, a voiced/unvoiced decision unit 22, an interpolate LPC coefficient in line spectrum pair (LSP) domain 23, a synthesis filter 24 which consists of an all-port filter and a de-emphasis filter, an amplitude calculation unit 25, a decoded envelope 26, a gain unit 27 and a post filter 28.

A periodic impulse train is passing through the vibrator 21 generating an aperiodic pulse to the voiced/unvoiced decision unit 22. On the other hand, a white noise is also sent to the voiced/unvoiced decision unit 22. In the voiced/unvoiced decision scheme according to the present invention, one frame is divided into four subframes, and each subframe is determined as being voiced or unvoiced based on a number of parameters, including normalized correlation (NC), energy, line spectrum pair (LSP) coefficient, and low to high band energy ratio (LOH) values to tremendously increase the accuracy of the vocoders. The details of the four level voiced/unvoiced decision scheme can be found in our co-pending application Ser. No. 08/821,594, filed Mar. 20, 1997, entitled "Quarter Voiced/Unvoiced Decision Method for Speech Coding", whose disclosure is incorporated by this reference as though set forth herein.

During sustained regions of slowly changing spectral characteristics, the frame-by-frame update can cope reasonably well. However, in the transition regions, the frame-by-frame update will fail as transitions fall within the frame. To ensure the outputs of the transition regions are more accurate, a popular technique is utilized to interpolate LPC coefficients in the LSP domain 23 before sending the LPC coefficients to the synthesis filter 24. The idea is to achieve an improved spectrum representation by evaluating intermediate sets of parameters between frames, so that transitions are introduced more smoothly at the frame edges without increasing the coding capacity. The smoothness of the processed speech was found to be considerably enhanced, and output quality of the speech spoken by faster speakers was noticeably improved. To reduce the computation numbers of LSP linear interpolation, the speech frame is divided into four subframes. The LSP coefficient used in each subframe is obtained by linear interpolation of the LSP coefficients between the current and previous frames. The interpolated LSP coefficients are then converted to LPC coefficients, which will be sent to both synthesis filter 24 and adaptive post filter 28.

Both the LPC coefficients from the synthesis filter 24 and the decoded envelope signals generated by the decoded envelope 26 are transmitted into the amplitude calculation unit 25 to produce a gain control signal which is sent to the gain unit 27, and then excites the post filter 28 to generate an enhanced synthetic speech output.

The inputs of the decoded envelope 26 are a quantized gain and the normalized shape of index. The envelope shape and quantized gain parameters of the synthetic speech are obtained by an analysis-by-synthesis loop.

Envelope coding is performed using a mean-square-error gain shape codebook approach. By minimizing the mean-square-error, the closest fit entry form a predetermined codebook is selected by:

$$\mathrm{Error}_{env}(i) = \sum_{k=0}^{N-1} (x_i - G_i y_{j,k})^2 \tag{3}$$

-continued $$G_i = \frac{\sum_{k=0}^{N-1} x_k y_{j,k}}{\sum_{k=0}^{N-1} y_{i,k} y_{j,k}} \tag{4}$$

where N=8, $x_k$ represents the envelope shape which is to be coded, $y_{i,k}$ represents the $i^{th}$ shape codeword, and $G_i$ is the optimum gain in matching the $i^{th}$ shape codeword of the input envelope. Referring now to FIG. 3, there is shown the 16 different shape codewords of a 4 bit quantizer according to the present invention. Once the optimum shape index has been determined, the associated gain is quantized to 7 bits using a logarithmic quantizer. Then, the shape index and quantized gain values are sent into the decoded envelope 26.

The gain of the excitation which is calculated in a way that the maximum amplitude of the synthetic speech just reaches the decoded envelope is described as follows:

(a) Voiced Subframes

For the voiced subframe, the input of the voiced/unvoiced decision unit 22 is a form of aperiodic pulses. The synthesis filter memory response (SFMR) is first found from the previous frame. The unit pulse response of the synthesis filter 24 at the current pulse position is then calculated by the amplitude calculation unit 25. The gain of this pulse can be estimated by:

$$\alpha_k = \min_i (\mathrm{abs}(Env_{k,i} / imp_res_{k,i})),\ p_0 \le i \le p_0 + r \tag{5}$$

where $\alpha_k$ is the $k^{th}$ pulse gain, $Env_{k,i}$ is the decoded envelope for the $k^{th}$ pulse at the position I, $imp_res_{k,i}$ is the impulse response, $P_0$ is the pulse position, and r is the search length, which is typically 10. After the gain of this pulse is found, this pulse is fed into the synthesis filter 24 which generates a synthetic signal. The SFMR value which is equal to the product of the synthetic signal and $\alpha_k$ is transmitted into the post filter 28 to produce a voiced synthesized speech output. The process is then repeated to find the gain of next pulse.

(b) Unvoiced Subframes

For the unvoiced subframes, the input of the voiced/unvoiced decision unit 22 is a form of white noise. The white-noise response of the synthesis filter is first calculated at the position of the entire subframe completely. This can avoid the undesirable situation that the amplitude of the synthetic signal exceeds the decoded envelope at this subframe. The gain of the white noise at the entire subframe can be estimated by:

$$\beta_j = \min_i (\mathrm{abs}(Env_{j,i} / \mathrm{noise}_res_{j,i})),\ w_0 \le i \le w_0 + sub_leng \tag{6}$$

where $\beta_j$ is the white-noise gain for the entire $j^{th}$ subframe, $Env_{j,i}$ is the decoded envelope for this white noise at position i, $\mathrm{noise}_res_{j,i}$ is the white-noise response, $W_0$ is the beginning position of each subframe, and sub_leng is the subframe length. After the gain of white noise is found, this white noise is fed into the synthesis filter 24 which generates a synthetic signal. The SFMR value which is equal to the product of the synthetic signal and $\beta_j$ is transmitted into the post filter 28 to produce an unvoiced synthesized speech output.

Upon the operation of the novel gain estimation scheme for the vocoder coding according to the present invention, smoother and natural voice outputs for vocoder applications are accomplished.

While the present invention has been particularly shown and described with reference to a preferred embodiment, it will be understood by those skilled in the art that various changes in form and detail may be without departing from the spirit and scope of the present invention.

What is claimed is:

1. A method for synthesizing speech based on encoded parameters, comprising:

(a) receiving pitch data, a set of filter coefficients, a shape index and a quantized gain that produces an envelope, and a voice/unvoiced parameter for a series of frames that are continuous in time;

(b) selecting a periodic impulse train or white noise based on the voiced/unvoiced parameter;

(c) providing the selected a periodic impulse train or white noise to a synthesis filter;

(d) providing the filter coefficients to the synthesis filter;

(e) determining a gain function based on the envelope and the output of the synthesis filter, the gain function calculated such that the maximum output of the synthesis filter excited by an input of the product of a unit impulse function and the gain approximates the envelope; and (f) multiplying the gain function and the output of the synthesis filter to produce a synthesized speech output.

2. The method of claim 1, wherein the filter coefficients are obtained by interpolating linear predictive coding (LPC) coefficients in a line spectrum pair (LSP) domain that is achieved by evaluating intermediate sets of parameters between frames to make the transitions smoother at frame edges without increasing coding capacity.

3. The method of claim 2, wherein the interpolating LPC coefficients in a line spectrum pair (LSP) domain is achieved by dividing each speech frame into four subframes, and the LSP coefficient used in each subframe is obtained by linear interpolation of the LSP coefficients between the current and previous frames, the interpolated LSP coefficients then being converted to LPC coefficients.

4. The method of claim 1, wherein said shape index and quantized gain are obtained by a predetermined codebook approach of 16 different shape codewords with 4 bits.

5. The method of claim 1, wherein said gain of voiced subframes is obtained by the steps of:

(a) calculating an unit pulse response of said synthesis filter at the current pulse position;

(b) calculating said gain of said current pulse by:

$$\alpha_k = \min_i(\mathrm{abs}(Env_{k,i} / imp_res_{k,i})),\ p_0 \le i \le p_0 + r$$

wherein $\alpha_k$ is the $k^{th}$ pulse gain;

$Env_{k,i}$ is the decoded envelope for the $k^{th}$ pulse at the position I;

$imp_res_{k,i}$ is the impulse response;

$P_O$ is the pulse position; and r is the search length (c) feeding said current pulse into said synthesis filter after said gain of said current pulse is obtained;

(d) multiplying said current pulse and said $\alpha_k$ to produce a synthesized speech output; and (e) repeating steps (a) through (d) for next pulse.

6. The method of claim 1, wherein said gain function of unvoiced subframes is obtained by the steps of:

(a) calculating a white-noise response of the synthesis filter at the position of the entire subframe completely;

(b) calculating said gain of said entire subframe by:

$$\beta_j = \min_i(\mathrm{abs}(Env_{j,i} / \mathrm{noise}_res_{j,i})),\ w_0 \le i \le w_0 + sub_leng$$

wherein $\beta_j$ is the white-noise gain for the entire $j^{th}$ subframe;

$Env_{j,i}$ is the decoded envelope for this white noise at position i;

$noise_res_{j,i}$ is the white-noise response;

$W_0$ is the beginning position of each subframe; and sub_leng is the subframe length (c) feeding said white-noise into said synthesis filter after said gain of said white-noise is obtained; and (d) multiplying said white-noise and said $\beta_j$ to produce a synthesized speech output.

* * * * *